US009815114B2

(12) United States Patent
Kondoh et al.

(10) Patent No.: US 9,815,114 B2
(45) Date of Patent: Nov. 14, 2017

(54) POWDER FOR MOLDING, LUBRICANT-CONCENTRATED POWDER AND METHOD FOR PRODUCING METAL MEMBER

(71) Applicants: Mikio Kondoh, Toyoake (JP); Nobuhiko Matsumoto, Seto (JP); Toshitake Miyake, Nagoya (JP); Kazumichi Nakatani, Toyota (JP)

(72) Inventors: Mikio Kondoh, Toyoake (JP); Nobuhiko Matsumoto, Seto (JP); Toshitake Miyake, Nagoya (JP); Kazumichi Nakatani, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 675 days.

(21) Appl. No.: 14/204,457

(22) Filed: Mar. 11, 2014

(65) Prior Publication Data

US 2014/0271327 A1 Sep. 18, 2014

(30) Foreign Application Priority Data

Mar. 13, 2013 (JP) ..... 2013-051091

(51) Int. Cl.

| | |
|---|---|
| ***B22F 1/00*** | (2006.01) |
| *B22F 3/12* | (2006.01) |
| *B22F 3/14* | (2006.01) |

(52) U.S. Cl.

CPC ..... *B22F 1/0059* (2013.01); *B22F 3/12* (2013.01); *B22F 2001/0066* (2013.01); *B22F 2003/145* (2013.01); *Y10T 428/2991* (2015.01)

(58) Field of Classification Search

CPC ..... B22F 1/005; B22F 2001/0066; B22F 2003/145; Y10T 428/2991

See application file for complete search history.

(56) References Cited

U.S. PATENT DOCUMENTS

| | | | | |
|---|---|---|---|---|
| 5,308,702 | A * | 5/1994 | Furukimi | C22C 33/0207 428/403 |
| 6,375,709 | B1 | 4/2002 | Storstrom et al. | |
| 6,413,919 | B2 * | 7/2002 | Vidarsson | B22F 1/0059 508/528 |
| 2004/0062674 | A1 | 4/2004 | Bergkvist et al. | |

FOREIGN PATENT DOCUMENTS

| | | | |
|---|---|---|---|
| JP | 01219101 | A | 9/1989 |
| JP | 2001-524605 | A | 12/2001 |
| JP | 2009-007641 | A | 1/2009 |
| JP | 2009-523907 | A | 6/2009 |
| JP | 2010-199222 | A | 9/2010 |
| WO | 2007084363 | A2 | 7/2007 |

* cited by examiner

*Primary Examiner* — Jennifer A Smith
*Assistant Examiner* — Alexandra M Moore
(74) *Attorney, Agent, or Firm* — Dinsmore & Shohl LLP

(57) ABSTRACT

A powder for molding is a mixture of first constituent particles, which are made up of first metal base particles, and second constituent particles, which are made up of second metal base particles. A first lubricant concentration that is a mass proportion of a first internal lubricant adhered to the surface of the first metal base particles with respect to the total of the first constituent particles, is greater than a second lubricant concentration that is a mass proportion of a second internal lubricant that is adhered to the surface of the second metal base particles with respect to the total of the second constituent particles.

11 Claims, 3 Drawing Sheets

ML2 POWDER 50 μm

STANDARD POWDER 50 μm

MLG2 POWDER 50 μm

STANDARD POWDER 50 μm

POWDER FOR MOLDING, LUBRICANT-CONCENTRATED POWDER AND METHOD FOR PRODUCING METAL MEMBER

INCORPORATION BY REFERENCE

The disclosure of Japanese Patent Application No. 2013-051091 filed on Mar. 13, 2013 including the specification, drawings and abstract is incorporated herein by reference in its entirety.

BACKGROUND OF THE INVENTION

1. Field of the Invention

The invention relates to a powder for molding that affords enhanced moldability (in particular, reduction in ejection force) while requiring less internal lubricant, to a lubricant-concentrated powder that is used to prepare a powder for molding and that is made up of metal base particles on the surface of which an internal lubricant is adhered at a high concentration, and to a method for producing a metal member, which is molded compact or sintered compact thereof, and obtained using the powder for molding.

2. Description of Related Art

Metal members of complex shape are produced by way of molded compacts resulting from pressure-molding a starting powder (powder for Molding) that fills the cavity of a die, and by way of sintered compacts resulting from heating the molded compacts. Such a production method allows significantly reducing production costs of the metal member, by, for instance, reducing cutting processes.

In order to produce stably high-quality metal members in accordance with such a method, it is important that the molded compact be removed smoothly, with a low ejection force, without occurrence of galling, seizure or the like between the starting powder or the molded compact and the inner wall surface of the cavity of the die, during pressure-molding of the starting powder and during ejection of the molded compact. Such being the case, internal lubricants have come to be added to and mixed with starting powders. The greater the addition amount of the internal lubricant, the more internal lubricant can be supplied at the boundary between the starting powder or molded compact and the inner wall surface of the die; accordingly, it is deemed that this may allow suppressing the occurrence of galling and the like during pressure molding and during ejection.

Internal lubricants, however, are fundamentally added merely with a view to enhancing moldability, and do not contribute to enhancing the characteristics of the metal member, but rather give rise to decreased density of the molded compact, and to increased porosity (lower pore-free density (PFD)). A greater amount of internal lubricant translates into a longer removal process (dewaxing process) of the internal lubricant, as required during sintering of the molded compact. Therefore, essentially the addition of the internal lubricant is implemented at an amount as small as possible.

Various approaches have been proposed, in the light of the above considerations, for reducing the amount of internal lubricant while suppressing the occurrence of galling or the like during molding. In this regard, the related art literature discloses for instance the features below.

Japanese Patent Application Publication No. 1-219101 (JP 1-219101 A) discloses the feature of performing warm molding at the temperature at which an internal lubricant melts, to cover thereby completely the surface of iron powder (starting powder) with comparatively little internal lubricant. The addition amount (total amount) of the internal lubricant as disclosed in the examples of JP 1-219101 A, however, is 1 mass %, which does not constitute a sufficient reduction in the amount of internal lubricant.

Published Japanese Translation of PCT application No. 2001-524605 (JP-A-2001-524605) discloses examples where the addition amount of internal lubricant is 0.6 mass %, which still does not constitute a sufficient reduction, as in the case of JP 1-219101 A.

Japanese Patent Application Publication No. 2009-523907 (JP 2009-523907 A) discloses an example where the addition amount of internal lubricant is reduced down to 0.4 mass %. In JP 2009-523907 A, however, a special metal powder is used wherein particles are covered beforehand with a metal salt of phosphoric acid, in order to reduce the addition amount of internal lubricant. Even using that special metal powder, the addition amount of internal lubricant can only be reduced at most down to 0.4 mass. Both JP-A-2001-524605 and JP 2009-523907 A use a starting powder that results from uniformly mixing a particulate internal lubricant into a metal powder.

SUMMARY OF THE INVENTION

The invention provides: a powder for molding that allows securing good moldability while reducing the addition amount of an internal lubricant; a lubricant-concentrated powder that is used to prepare the powder for molding; and a method for producing a metal member that is made up of a molded compact, or a sintered compact thereof, that utilizes the powder for molding.

As a result of diligent research and trial and error directed at attaining the above goal, the inventors conceived of a powder for molding wherein an internal lubricant is not uniformly distributed in a starting powder but in which, contrary to common technical knowledge, metal base particles with concentrated internal lubricant are mixed into the starting powder. Through the use of this powder for molding it became possible to achieve a molded compact that exhibits low ejection force, without occurrence of galling, seizure or the like, and while reducing the addition amount of internal lubricant in the powder as a whole. These results were developed to perfect the invention that is described hereafter.

Powder for Molding (1) The powder for molding in an aspect of the invention is a powder for molding having mixed therein first constituent particles, made up of first metal base particles, and second constituent particles, made up of second metal base particles. A first lubricant concentration that is a mass proportion of a first internal lubricant adhered to the surface of the first metal base particles with respect to the total of the first constituent particles, is greater than a second lubricant concentration that is a mass proportion of a second internal lubricant that is adhered to the surface of the second metal base particles with respect to the total of the second constituent particles.

(2) Through the use of the powder for molding in the above aspect of the invention it becomes possible to remove a molded compact from a die, with a low ejection force, without occurrence of galling, seizure or the like during molding, while reducing the content of internal lubricant (also referred to as "lubricant amount") with respect to the powder as a whole or the molded compact as a whole. A reduction in the lubricant amount in the molded compact results in enhanced PFD, and by extension, in higher density and higher strength of the molded compact and sintered compact. The dewaxing step at the time of sintering is accordingly shortened, which translates into a reduction in the production costs of the sintered compact.

(3) The underlying reasons why the powder for molding in the above aspect of the invention elicits the above advantageous effect are not necessarily clear, but involve arguably the following. In the related art, it has been deemed that the blending proportion of internal lubricant (lubricant amount) can be reduced as a consequence of enhanced moldability achieved by performing molding with a micro-particulate internal lubricant evenly dispersed thinly and sparsely in a metal powder. It is believed that mixing a coarse-grained internal lubricant into a metal powder translates by contrast into an increased proportion of metal base particles that are in direct contact with the inner wall surface of the die, which entails a higher likelihood of occurrence of galling, seizure and the like. The specific gravity of internal lubricants is significantly lower than that of metal base particles, and hence coarse particulate internal lubricants float up from inside the metal powder and separate readily from the latter. It has been thus difficult to uniformly mix internal lubricants and metal powders, and to fill a die with the foregoing while still in a uniformly mixed state. In this context, the idea of distributing an internal lubricant unevenly within a powder for molding in itself has hitherto not been conceived of at all.

The inventors found however that, contrary to common technical knowledge, pressure-molding of the above-described powder for molding in the above aspect of the invention resulted in absence of galling, seizure and the like, but, conversely, made it possible to reduce the ejection force of the molded compact. The reason for this is that constituent particles of high lubricant concentration have also a large amount of lubricant that is adhered to the surface of the metal base particles of the constituent particles. The presence of such constituent particles affords, as it were, a state close to that where a coarse-grained (bulk) internal lubricant is present in the powder. When such constituent particles are compressed during pressure molding, the coarse internal lubricant at the surface does not just fill up gaps between metal base particles, but flows readily, around the particles or outwards (in other words, the internal lubricant seeps out readily). Such instances occur also in the vicinity of the boundary between the metal base particles and the inner wall surface of the die. This is deemed to afford a curtailment of galling, seizure and the like during molding, as well as a reduction in the ejection force of the molded compact, while reducing the lubricant amount with respect to the powder as a whole.

In the powder for molding in the above aspect of the invention, a granular internal lubricant is not merely in a mixed state with a metal powder, as in the related art; instead, a concentrated or coarsened internal lubricant (first internal lubricant) is in a state (first constituent particles) of being adhered to the surface of metal base particles. In the powder for molding in the above aspect of the invention, accordingly, there occurs no separation upon mixing or filling of the internal lubricant and the metal powder, as described above, and the powder for molding is readily brought to a state where first constituent particles and second constituent particles as referred to in the above aspect of the invention are mixed substantially uniformly at a desired blending proportion, in other words, the powder for molding is readily brought to a state where the concentrated internal lubricant is dispersed (scattered) substantially uniformly.

It is deemed that the greater the plastic deformation, during pressure molding, of the metal base particles to which the internal lubricant is adhered to, the greater becomes the amount of internal lubricant that seeps out onto the periphery of the metal base particles. Further, the coarser the metal base particles, the more readily the latter undergo significant plastic deformation during pressure molding. Accordingly, the first particle size, which is an index of the size of the first metal base particles (metal base particles having concentrated or coarsened internal lubricant adhered thereto) in the above aspect of the invention may be set to be greater than the second particle size that is an index of the size of the second metal base particles. The size of the metal base particles may be also indicated by, for instance, the average particle diameter or the like of a predetermined number of metal base particles, as calculated through image processing or the like, but herein it is convenient to work out the size of the particles by relying on the particle size as determined by sieving (JIS Z 8801).

Lubricant-Concentrated Powder

The above aspect of the invention can be grasped not only as a powder for molding, but also as a lubricant-concentrated powder that constitutes a supply source of the above-described first constituent particles. Specifically, the above aspect of the invention can also be grasped as a lubricant-concentrated powder made up of metal base particles, having an internal lubricant that is concentrated at, and adhered to, the surface, wherein a lubricant concentration, being a mass proportion of the internal lubricant with respect to the metal base particles, ranges from 1 to 5 mass %, and the lubricant-concentrated powder constitutes a supply source of the above-described first constituent particles. Such a lubricant-concentrated powder can be obtained, for instance, through mixing of a metal powder made up of the metal base particles, and the internal lubricant fully melted.

Method for Producing a Metal Member

The above aspect of the invention can also be grasped as a method for producing a molded compact or sintered compact made up of the above-described powder for molding. Specifically, the above aspect of the invention can also be grasped as a method for producing a metal member (molded compact), wherein the method has a warm molding step of obtaining a molded compact through pressing of the above-described powder for molding in a heated die. In the above aspect of the invention there is no preferred temperature at the time of molding of the powder for molding. However, warm molding further facilitates seeping of the internal lubricant and allows enhancing boundary lubricity in the vicinity of the inner wall surface of the die. Warm molding may be performed through heating of the die at a temperature lower than the lowest melting point from among the internal lubricants that are used (also referred to hereafter as "lowest melting point"). For instance, the die may be heated at an appropriate temperature within a range from 60 to 100° C., in accordance with the type of the internal lubricants.

The above aspect of the invention can be grasped as a method for producing a metal member (molded compact) further having a sintering step of obtaining a sintered compact through heating of the molded compact. In this case, using the above-described powder for molding allows shortening a dewaxing step and reducing the production costs of the sintered compact. The above aspect of the invention can also be grasped as a molded compact or sintered compact obtained in accordance with the above-described production method.

Others (1) As referred to herein, the terms "first" and "second" in the above aspect of the invention are used for convenience, such that the internal lubricant that is concentrated is referred to as "first", and is referred to as "second" otherwise. The first constituent particles are made up of at least first metal base particles and a first internal lubricant adhered to the surface of the first metal base particles, but the first constituent particles may include, as appropriate, modifying particles (alloy element particles, graphite, carbon black (CB)) and the like.

In some instances, conversely, the second constituent particles may be made up of second metal base particles alone. In this case, there is no second internal lubricant, and hence the second internal lubricant may be regarded as substantially zero. The fillability of the powder for molding is enhanced, and the ejection force of the molded compact reduced, when the second constituent particles are particles in which a small amount of second internal lubricant is adhered to the surface of the second metal base particles. As in the case of the first constituent particles, the second constituent particles may include various modifying particles.

The powder for molding of the above aspect of the invention is not limited to only two types, namely first constituent particles and second constituent particles, and may include instances where the powder for molding is made up of three or more types of constituent particles. In the powder for molding of the above aspect of the invention, the proportion of the internal lubricant adhered to the metal base particles (lubricant concentration), may be deliberately adjusted or controlled to dissimilar states (concentrated versus sparse state) between different constituent particles. In a case where the powder for molding of the above aspect of the invention is made up of three or more types of constituent particles, those constituent particles of largest lubricant concentration may be regarded as the first constituent particles, and the constituent particles of lowest lubricant concentration may be regarded as the second constituent particles.

The ejection force is for instance reduced when a lubricant concentration ratio (Lr=L2/L1) of the second lubricant concentration (L2) with respect to the first lubricant concentration (L1) in the powder for molding of the above aspect of the invention lies in the range of 0.01 to 0.5, or 0.03 to 0.4, or yet 0.05 to 0.35. The first lubricant concentration may be set to a range of 0.4 to 5 mass % (or simply "%"), or 0.8 to 4%, or 1 to 3%, or yet 1.5 to 2.5%. The second lubricant concentration may be set to be 0.2% or less, 0.17% or less, 0.12% or less, or yet 0.08% or less. The lower limit of the second lubricant concentration may be zero, or may be set to 0.01% or more, or yet 0.03% or more.

It is an object of the above aspect of invention to reduce the addition amount of internal lubricant in the powder for molding as a whole, while securing good moldability. From this viewpoint as well, the total amount of internal lubricant contained in the powder for molding of the above aspect of the invention may be set to be 0.35% or less, or 0.3% or less, or yet 0.25% or less, with respect to 100 mass % (or simply "%") of the powder as a whole.

The first constituent particles may be set to be fewer than the second constituent particles, in order to reduce the lubricant amount in the powder for molding as a whole, while having the first constituent particles of high lubricant amount mixed into the powder for molding. For instance, the first constituent particles may be set to 3 to 30%, or 7 to 25% with respect to 100 mass % as the powder for molding as a whole, although variations arise depending on the lubricant concentration and the total amount of internal lubricant in the respective constituent particles. Most of the mass of the respective constituent particles is made up of the metal base particles. Accordingly, the mass proportion of the constituent particles is substantially identical to the proportion of the metal base particles that constitute the base of the respective constituent particles. Therefore, the mass proportion of the metal base particles may substitute for the mass proportion of the constituent particles.

(2) The powder for molding of the above aspect of the invention has been expressed in the above-described manner, since the powder for molding is an aggregate of the constituent particles. Ordinarily, however, the powder for molding is prepared by mixing two or more types of starting powders having dissimilar lubricant concentrations (for instance, a first starting powder made up of first constituent particles and a second starting powder made up of second constituent particles). Accordingly, it is not practical to evaluate the lubricant concentration and the like of the above aspect of the invention on a unit basis, namely on the basis of individual specific particles that are sampled arbitrarily. Therefore, the terms "lubricant concentration", "particle size" and the like in the constituent particles of the above aspect of the invention are evaluated on the basis of representative values that are obtained through inspection and analysis of 100 g of a sample powder that is randomly sampled from the powder for molding or from the starting powders thereof. These representative value are, for instance, an average value, for lubricant concentration, or a particle size distribution that is worked out through sieving, for particle size.

(3) Unless otherwise stated, the language "x to y" in the specification is meant to include the lower limit x and the upper limit y. A range such as "a to b" may be newly established by setting the various numerical values, or any numerical value included in the numerical value ranges, as set forth in the specification, to a new lower limit value or upper limit value. The term "moldability" in the specification encompasses, for instance, powder fillability, galling resistance, seizure resistance and reduction of ejection force.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
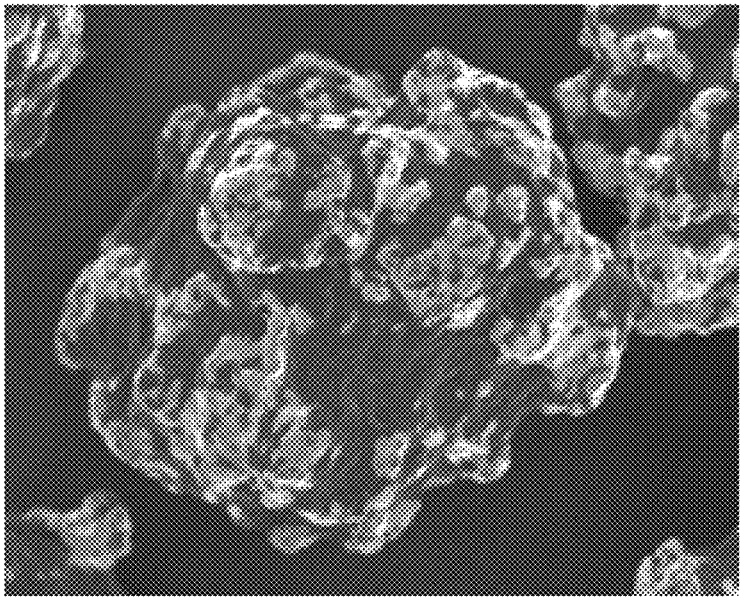
FIG. 1A is a scanning electron microscope (SEM) micrograph of a constituent particle of a ML2 powder.

The content of the explanation in the specification applies suitably not only to the powder for molding and the lubricant-concentrated powder of the invention, but also to a molded compact or sintered compact (metal member) that is produced using the powder for molding, and to a method for producing that metal member. The description relating to the method, when understood as product-by-process, applies likewise to constituent elements relating to that product. Any one or more features selected from the specification may be freely added to the abovementioned invention. The intended purpose and required performance, among other factors, will determine whether any given embodiment is optimal or not.

Starting Material Powder (1) Metal Base Particles (Metal Powder)

The metal base particles according to the invention have no preferred composition, form, or type, but are typically iron base particles having iron (Fe) as a main component. The composition of the iron base particles may include pure iron or iron alloys. The metal base particles (or powder thereof) may be made up of a powder of a single type, or may be a combination of two or more types of simple powders having dissimilar compositions, production methods, particle shape distributions and the like. For instance, an iron-based powder made up of iron base particles may be a mixed powder of pure iron powder and an alloy powder made up of an iron alloy or a non-iron alloy, or may be a mixed powder of two or more atomized powders (for instance, water-atomized powders or gas-atomized powders) obtained through dissimilar production methods and having dissimilar particle shapes (grain shapes).

(2) Strengthening Powder, Modifying Powder

The metal member of the invention may be a molded compact such as a powder magnetic core, or a sintered compact that constitutes a structural member or the like. In a case where the metal member of the invention is a sintered compact, the starting powder may include strengthening elements and/or modifying elements. Characteristics amenable to strengthening include, for instance, strength, elongation and toughness, while characteristics amenable to modification include, for instance, sinterability, dimensional stability and machinability. Examples of such elements include, for instance, C, Cu, Ni, Cr, Mn, Si, V, Mo, P, S, W and the like. These elements may be incorporated into a powder of metal base particles; alternatively, a composition may be prepared through mixing of the foregoing, in the form of a separate powder (strengthening powder or modifying powder), into the starting powder. Examples of such powders include, for instance, graphite (Gr) powders, Cu powders, Cu alloy powders, Fe—Cr-alloy powders, Fe—Mo alloy powders, Fe—Mn—Si alloy powders, Fe—P powders and the like.

The powder for molding of the invention may contain a CB powder, separately from a modifying powder such as graphite. A small amount of CB may enhance the fillability of the powder for molding in the die cavity. The content of CB may range from 0.005 to 0.05%, or yet 0.01 to 0.04%, with respect to 100% as the powder for molding as a whole.

(3) Particle Size Distribution

In the powder for molding of the invention, particles of large particle diameter may be used as the first metal base particles or the first constituent particles, while particles of small particle diameter may be used as the second metal base particles or the second constituent particles. These particle diameters are defined by particle sizes worked out through sieving according to JIS Z 8801 described above. Particle size is expressed herein as "−a μm", "+b μm" or "−a μm/b μm", where "−a μm" indicates that particles or a powder pass through a sieve of nominal opening a μm, and "+b μm" indicates that particles or a powder do not pass through a sieve of nominal opening b μm. Further, "−a μm/(+)b μm" indicates that particles or a powder pass through a sieve of nominal opening a μm, but not through a sieve of finer nominal opening b μm.

Internal Lubricant

The internal lubricant according to the invention has no preferred type, composition and so forth, and may be not only a single internal lubricant, but also a composite lubricant resulting from mixing two or more types. For instance, the internal lubricant according to the invention may be made up of a composite lubricant of one or more types of lubricant from among fatty acid amides, saturated fatty acids, higher alcohols, ester waxes, amide waxes and metal soaps. Examples of fatty acid amides include, for instance, one or more types from among stearic acid amide, ethylene-bis-oleamide, ethylene-bis-stearic acid amide, oleic acid amide, erucic acid amide, ethylene-bis-erucic acid amide and the like. Examples of saturated fatty acids include, for instance, palmitic acid, stearic acid, alginic acid, behenic acid and the like. Examples of higher alcohols include, for instance, one or more types from among behenyl alcohol, cetyl alcohol, stearyl alcohol, lignoceryl alcohol and the like. The content of higher alcohol may be set to range from 15 to 60%, or yet 5 to 45%, with respect to 100% as the total composite lubricant.

Examples of ester waxes include, for instance, one or more types from among fatty acid alkyl esters, pentaerythritol fatty acid esters and the like. Examples of metal soaps include, for instance, one or more types from among zinc stearate, lithium stearate, calcium stearate, magnesium stearate and the like.

Incidentally, the internal lubricant at the surface of the constituent particles plays also a role in preventing scattering of various modifying particles, CB particles and the like, through adhesion of these particles to the surface of the constituent particles. In this respect, the internal lubricant may be adhered, in small amounts, not only to the first constituent particles at which the internal lubricant is concentrated, but also to the second constituent particles. The internal lubricant that is adhered to the surface of the first constituent particles and the internal lubricant that is adhered to the surface of the second constituent particles may be of dissimilar type, composition and so forth, and may be adhered in accordance with dissimilar adhesion methods. The internal lubricant is not limited only to instances where the internal lubricant is supplied through adhesion to the surface of the metal base particles. For instance, the powder for molding of the invention may include very small amounts of a granular internal lubricant that has been separately mixed into the powder for molding.

Molding and Sintering

No preferred molding conditions apply to the powder for molding of the invention. The powder may be cold-molded or warm-molded, the molding pressure that is applied may range ordinarily from 400 to 850 MPa, although ultra-high pressure beyond these ranges may also be resorted to. The molding pressure depends also on the melting point of the lubricant that is used. Herein, the density of the molded compact and, accordingly, of the sintered compact, is increased by performing warm molding with a die temperature set to a range of 60 to 100° C. The use of the powder for molding of the invention for die-lubricated molding is not ruled out, although that is ordinarily not necessary, inasmuch as the powder for molding of the invention has an internal lubricant.

There are no preferred sintering conditions, but sintering involves ordinarily furnace heating or high-frequency heating in an antioxidant atmosphere such as a nitrogen atmosphere, at a temperature range of 1050 to 1250° C., for 1 to 120 minutes. The sintered compact may be subjected, as appropriate, to various thermal treatments such as annealing, normalizing, aging, thermal refining (quenching, tempering), carburizing, nitriding and the like.

Applications

No particular restrictions apply to the forms and uses of the molded compact and sintered compact obtained from the powder for molding of the invention. Examples of the use of the sintered compact include, for instance, various types of pulleys, synchronizer hubs in transmissions, engine connecting rods, hub sleeves, sprockets, ring gears, parking gears, pinion gears and the like, in the automotive field. Other uses include, for instance, sun Gears drive gears, driven gears, reduction gears and the like.

FIRST EXAMPLE

Preparation of a Sample Powder (1) Starting materials

There were prepared a pure iron powder (ASC100.29/−212 μm, by Hoganas AB) made up of pure iron base particles, a graphite powder (Gr) (J-CPB/average particle diameter: 5 μm, by Nippon Graphite Industries), as a modifying powder, as well as the internal lubricants given in Table 1. The pure iron powder (metal powder) above was water-atomized in all instances.

TABLE 1

| Lubricant denomination | Generic term | Name | Melting point (° C.) | Product name | Manufacturer |
|---|---|---|---|---|---|
| kal | Higher alcohol | Behenyl alcohol | 70 | KALCOL 220-80 | Kao Corporation |
| S10 | Fatty acid amide | Stearic acid mono-amide | 102 | ALFLOW S10 | NOF Corporation |
| kenolub | — | — | — | Kenolub | Hoganas AB |

(2) Master Lubricant

Powder Preparation

The pure iron powder above or a powder resulting from classifying the foregoing according to particle size, as well as the internal lubricants given in Table 1, were subjected to a complete melt mixing process, to prepare thereby a plurality of master lubricant powders (lubricant-concentrated powders) made up of particles (first constituent particles) on the surface whereof the internal lubricant was adhered at a high concentration. More specifically, there were prepared a pure iron powder, as procured (pure iron powder I), a pure iron powder resulting from sieving the procured pure iron powder to a particle size of −212 μm/+106 μm (pure iron powder II), and a pure iron powder similarly obtained, to a particle size of −106 μm (pure iron powder III). The lubricant kal and the lubricant S10 in Table 1 were each added, in an amount of 1%, to the powders (addition amount to a total 2% with respect to the powder as a whole after adjustment), followed by a full melt-mixing process.

Three master lubricant powders were obtained as a result (also referred to as "ML powders"), namely a ML1 powder (pure iron powder I+1% kal+1% S10), a ML2 powder (pure iron powder II+1% kal+1% S10) and a ML3 powder (pure iron powder III+1% kal+1% S10). Unless otherwise indicated, the addition amount of internal lubricants, Gr and so forth in the specification refer to mass % (expressed simply as "%") with respect to the powder as a whole after preparation.

The full melt-mixing process was performed as described next. Firstly, the whole was mixed using a heat mixing apparatus (High-speed mixer LFS-SG-2J by Fukae Powtech) for 5 minutes, at 150 rpm agitator revolutions, and at a temperature of 150° C., at which all the internal lubricants melt completely. The obtained mixture was then cooled down to a temperature (room temperature) not higher than the melting point of the internal lubricants, and the resulting solidified product was crushed. Respective master lubricant powders were prepared in this manner.

(3) Preparation of a Sample Powder (Powder for Molding)

A base powder to be mixed with each of the master lubricant powders was prepared first. The base powder was prepared by subjecting the above-described pure iron powder (powder as procured, particle size: −212 μm), 0.88% of Gr, 0.05% of kal and 0.05% of S10, to the above-described full melt-mixing process. The total amount of internal lubricants in the base powder (hereafter also referred to as "BG powder") was 0.1% with respect to the powder as a whole.

Any one of the above-described ML powders was added, in an amount of 10%, to the BG powder, and the whole was mixed for 30 minutes in a ball mill. Three sample powders (MLG1 powder to MLG3 powder) were prepared that way. These were ML1 powder: BG powder+10% ML1 powder, ML2 powder: BG powder+10% ML2 powder, and ML3 powder: BG powder+10% ML3 powder. The total amount of internal lubricant in each powder was 0.3% with respect to the powder as a whole, in all cases.

Further, a standard powder (Fe-0.8%+0.15% kal+0.15% S10) having a greater internal lubricant amount than that of the BG powder (Fe-0.88%+0.05% kal+0.05% S10) was also prepared by carrying out the above-described full melt-mixing process.

A comparative powder (Fe-0.8%+0.3% kenolub) was further prepared through simple mixing, for 30 minutes in a ball mill, of the above-described pure iron powder (powder as procured, particle size: −212 μm), 0.8% of Gr and 0.3% of kenolub.

Molding and Sintering (1) Molded compacts were produced using the sample powders described above, and respective sintered compacts (metal members) were produced through sintering of the molded compacts. Each molded compact was obtained by filling the cavity of a die, heated at 60° C., with 30 g of the respective sample powder, followed by pressing at 686 MPa (warm molding process). The die was made of an ultra-hard alloy. The cavity of the die was cylindrical, with ϕ23 mm. The surface roughness Ra (JIS) of the inner wall surface of the die was 0.1 μm.

The flow rate (FR) and apparent density (AD) of each sample powder were measured in accordance with JIS Z 2502, 2504. The load (ejection force) necessary to eject the molded compact out of the die, after pressure molding of each sample powder, was measured using a load cell of a compression molding machine. The mass and dimensions of the molded compacts were measured to calculate the respective molded compact densities (G.D.). The results are summarized in Table 2.

TABLE 2

| Powder name | Moldability FR (sec/50 g) | AD ($g/cm^3$) | Molded compact density G.D. ($g/cm^3$) | Ejection force (MPa) | Sinterability Sintered compact density S.D. ($g/cm^3$) | dimensional change ΔD (%) |
|---|---|---|---|---|---|---|
| MLG1 | 25.3 | 3.28 | 7.32 | 12.8 | 7.27 | 0.16 |
| MLG2 | 23.8 | 3.31 | 7.32 | 11.8 | 7.27 | 0.15 |
| MLG3 | 24.6 | 3.26 | 7.32 | 13.1 | 7.27 | 0.16 |
| Standard | 23.6 | 3.28 | 7.33 | 14.3 | 7.27 | 0.16 |
| Comparative | 26.2 | 3.33 | 7.31 | 18.2 | 7.27 | 0.09 |

The total amount of internal lubricant with respect to the powder as a whole is 0.3 mass % in all instances (2) The obtained molded compacts were heated in a nitrogen atmosphere at 1150° C. for 30 minutes, to yield a respective sintered compact. The mass and dimensions of each sintered compact were measured, to calculate respective sintered compact densities (S.D.) and dimensional changes (ΔD). These results as well are summarized in Table 2.

Evaluation (1) Moldability

A comparison between the standard powder and the comparative powder and the MLG1 to MLG3 powders in Table 2 reveals that the ejection force can be significantly reduced by using a powder having mixed thereinto constituent particles of dissimilar lubricant concentration. The reduction in ejection force was particularly significant in the ML2 powder, where a ML powder of large particle size was added to, and mixed with, the BG powder.

The MLG1 to MLG3 powders (in particular, the MLG2 powder) exhibited also excellent powder fillability, as made apparent by the FR and AD.

(2) Surface Observation

Figure 1B:
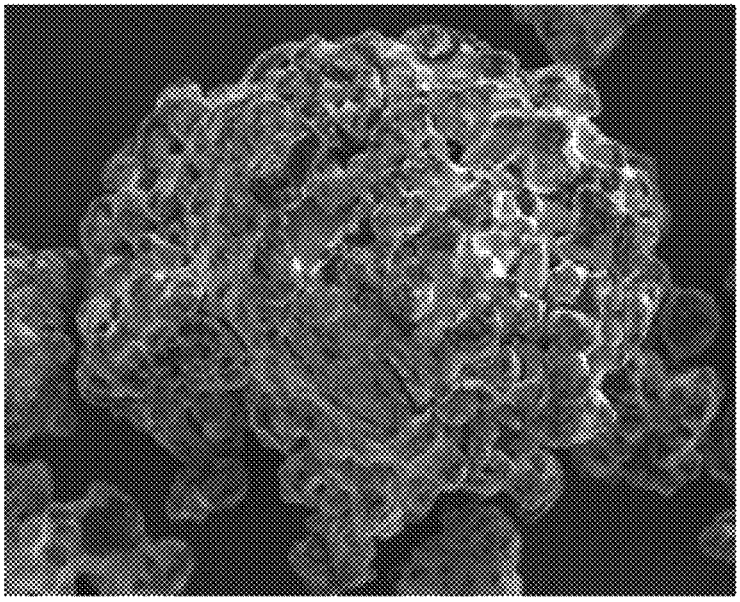
FIG. 1B is a SEM micrograph of a constituent particle of a standard powder.

FIG. 1A and FIG. 1B illustrate SEM images of observations of the surface of respective constituent particles of the ML2 powder and the standard powder. The portions visible as black in the micrographs are internal lubricant that is adhered to the particle surface. As FIG. 1A shows, the constituent particles of the ML2 powder have internal lubricant adhered thereon at a high concentration, so as to fill the recesses of the pure iron base particles. In the constituent particles of the standard powder, by contrast, a small amount of internal lubricant is adhered thinly and substantially uniformly over the surface of the pure iron base particles, as can be seen in FIG. 1B.

Figure 2A:
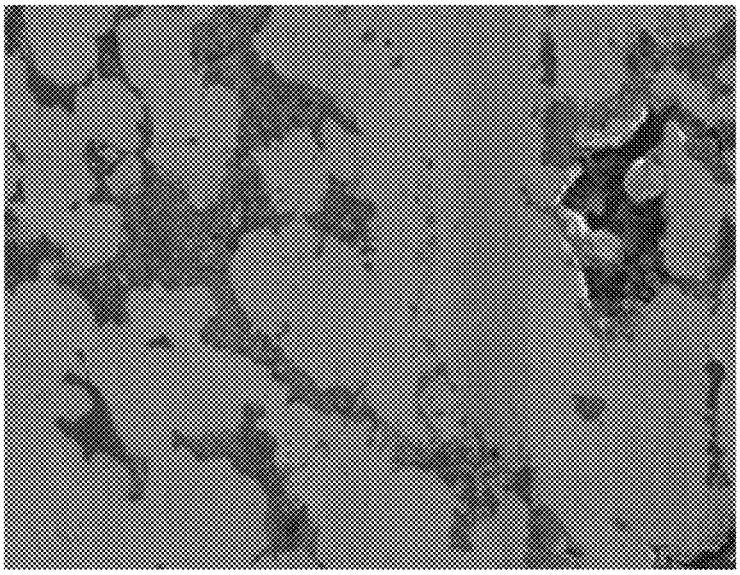
FIG. 2A is a SEM micrograph of the surface of a molded compact resulting from molding using a MLG2 powder.
Figure 2B:
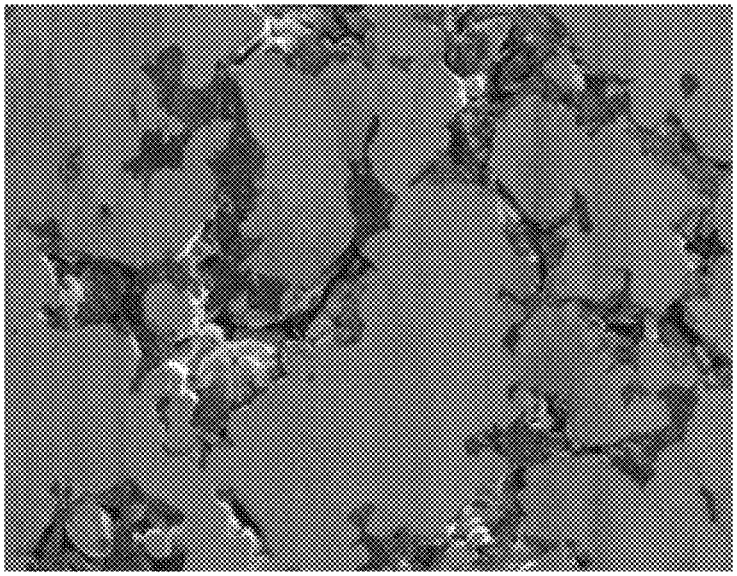
FIG. 2B is a SEM micrograph of the surface of a molded compact resulting from molding using a standard powder.

The surfaces of respective molded compacts, obtained through warm molding of the standard powder and the MLG2 powder, in which the ML2 powder was added to the BG powder, were likewise observed. FIG. 2A and FIG. 2B illustrate the resulting SEM micrographs. The portions that appear black in the micrographs are internal lubricant. A comparison between the two micrographs reveals that, although the total amount of internal lubricant is identical in both instances, the molded compact in which the MLG2 powder is used exhibits more internal lubricant in the vicinity of the surface of the molded compact, and fewer portions at which the pure iron base particle is exposed (white portions). This indicates that a greater amount of lubricant seeps to the vicinity of the surface of the molded compact (boundary with the inner wall surface of the die) when molding is performed using the MLG2 powder.

SECOND EXAMPLE

Preparation of a Sample Powder

The first example showed that remarkable moldability is enhanced (in particular, in terms of reduction of ejection force) by using a powder for molding that includes coarse particles of high lubricant concentration (L1) (high-concentration coarse particles). Such being the case, an assessment was performed, as described below, on the influence exerted on moldability (in particular, ejection force) by a lubricant concentration ratio (Lr=L2/L1) in a powder for molding resulting from mixing a powder (low-concentration fine particles) made up of fine particles of low lubricant concentration (L2) and a powder (high-concentration coarse powder) made up of high-concentration coarse particles.

Firstly, the pure iron powder (particle size: −212 μm) was classified, by sieving, into a coarse iron powder having a particle size: −150 μm/+106 μm and into a fine iron powder having a particle size: −106 μm. For reference, the particle size distribution of the pure iron powder (−212 μm) before particle size classification was ascertained for three lots. The results are given in Table 3. As the particle size distributions illustrated in Table 3 indicate, particles having a particle size: +150 μm and which constitute about 7 to 8%, are cut off as a result of the above-described particle size classification, such that about 17 to 20% is used as coarse iron powder, and the balance is used as fine iron powder.

TABLE 3

| Lot. No. | Particle size distribution (mass %) −212 μm/ +180 μm | −180 pm/ +150 μm | −150 μm/ +106 μm | −106 μm/ +75 μm | −75 μm/ +63 μm | −63 μm/ +45 μm | −45 μm |
|---|---|---|---|---|---|---|---|
| 1 | 1.2 | 6.0 | 16.6 | 20.9 | 12.5 | 18.8 | 23.9 |
| 2 | 1.1 | 6.4 | 18.9 | 22.5 | 12.6 | 18.2 | 20.3 |
| 3 | 1.0 | 6.9 | 19.5 | 22.7 | 12.2 | 17.8 | 19.8 |

Respective sample powders illustrated in Table 4 were prepared using the coarse iron powders and fine iron powders described above, as well as Gr and the internal lubricants (kal and S10) described above. In each sample powder, the coarse iron powder and the fine iron powder were blended at a ratio (mass ratio) of 1:4. Herein, Gr was added in a proportion of 0.8% with respect to the total coarse iron powder or the total fine iron powder (Gr constitutes about 0.8% of the total sample powder).

TABLE 4

| | Internal lubricant | | | | Moldability | | | |
|---|---|---|---|---|---|---|---|---|
| | Lubricant concentration by powder | | | | | | | |
| Sample powder | Coarse iron powder L1 (%) | Fine iron powder L2 (%) | Lubricant concentration ratio Lr (L2/L1) | Total lubricant (%) | FR (sec/50 g) | AD ($g/cm^3$) | Molded compact density G.D. ($g/cm^3$) | Ejection force (MPa) |
| 11 | 1.0 | 0.0 | 0.0 | 0.2 | 26.4 | 2.89 | 7.31 | 16.7 |
| 12 | 0.8 | 0.05 | 0.06 | 0.2 | 24.1 | 3.26 | 7.31 | 14.0 |
| 13 | 0.6 | 0.1 | 0.17 | 0.2 | 22.9 | 3.25 | 7.32 | 14.9 |
| 14 | 0.4 | 0.15 | 0.38 | 0.2 | 22.1 | 3.27 | 7.34 | 15.9 |
| C1 | 0.2 | | 1.0 | 0.2 | 21.5 | 3.28 | 7.34 | 17.3 |
| C2 | 0.3 | | 1.0 | 0.3 | 21.3 | 3.29 | 7.33 | 13.5 |
| C3 | 0.4 | | 1.0 | 0.4 | 21.1 | 3.27 | 7.32 | 11.3 |

Overall composition of sample powders: Fe-0.8% Gr+a % kal+a % S10 (a=t/2)

Coarse iron powder: fine iron powder=1:4 (mass proportion)

The internal lubricants in each powder were kal:S10 of 1:1 (mass ratio). The internal lubricants were caused to be adhered to the particles by performing the above-described full melt-mixing process. The lubricant concentration or total amount of internal lubricant was set to vary for each sample powder. For a lubricant concentration of coarse iron powder of 0.8% in sample powder 12, for instance, kal and S10 adhered to the coarse iron powder in the sample powder 12 are each worked out as 0.8×(⅕)×(½)=0.08%, and the total amount of both lubricants adhered to the coarse iron powder in sample powder 12 is 0.16%. The lubricant concentration in the fine iron powder is 0.05%, and hence kal and S10 adhered to the fine iron powder in sample powder 12 are each worked out as 0.05×(⅘)×(½)=0.02%, and the total amount of both lubricants adhered to the fine iron powder in sample powder 12 is 0.04%. The total of internal lubricant adhered to the particles is 0.16+0.04=0.2%, when considering the sample powder 12 as a whole.

Sample powders 11 to 14 result from mixing in a ball mill, for 30 minutes, coarse iron powders and fine iron powders having the internal lubricants separately adhered thereon as a result of the above-described full melt mixing. Sample powders C1 to C3, by contrast, result from performing the above-described full melt mixing on mixed powders that are obtained by mixing beforehand coarse iron powders and fine iron powders.

Molding (1) The above-described sample powders were warm-molded in the same way as in the first example, to produce cylindrical molded compacts. The moldability of each sample powder at the time of molding was measured in the same way as in the first example. The obtained results are summarized in Table 4.

Figure 3:
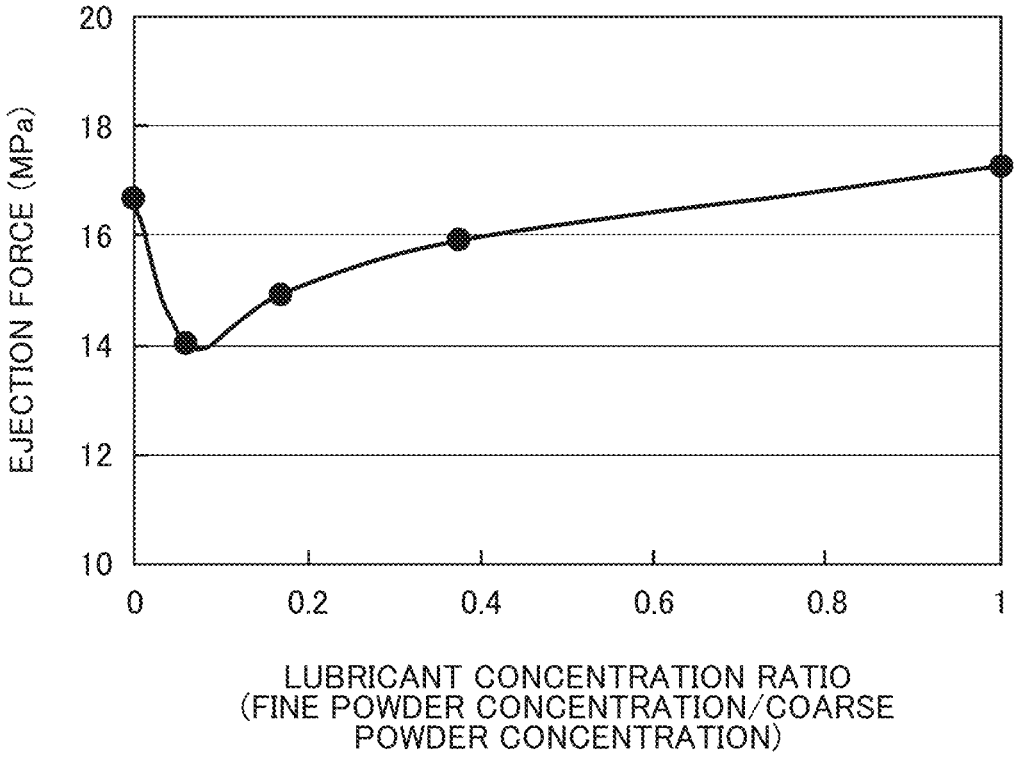
FIG. 3 is a graph illustrating a relationship between lubricant concentration ratio and ejection force.

(2) On the basis of the results in Table 4, FIG. 3 illustrates the relationship between lubricant concentration ratio and ejection force for sample powders 11 to 14 and sample powder C1, where the total amount of internal lubricant is 0.2%.

Evaluation

The density of the molded compacts exhibited no large differences, irrespective of the sample powder that was used. AD dropped significantly in sample powder 11, where no internal lubricant was adhered to the fine iron powder, but other powders exhibited no large difference in AD. FR and ejection force improved as the total amount of internal lubricant increased. For a given total amount of internal lubricant, a higher lubricant concentration in the low-concentration fine powder translated into higher fluidity.

As FIG. 3 shows, a comparison between sample powders 11 to 14 and sample powder C1, all of which have the same total amount of internal lubricant, reveals that ejection force is further reduced when the lubricant concentration ratio (Lr=L2/L1), which is the ratio of the lubricant concentration (L2) of the fine iron powder with respect to the lubricant concentration (L1) of the coarse iron powder, lies within a specific range (for instance, 0.01 to 0.5). The total amount of internal lubricant in sample powder 12 is small, of 0.2%, but the powder exhibits an ejection force similar to that of sample powder C2, where the total amount of internal lubricant is 0.3%.

Accordingly, it is found that the use amount of internal lubricant is reduced, and moldability is secured or enhanced, by combining powders that have dissimilar lubricant concentrations and/or particle sizes, and by using a high-concentration coarse powder and a low-concentration fine powder.

What is claimed is:

1. A powder for molding, comprising:

first constituent particles including first metal base particles and a first internal lubricant adhered to a surface of the first metal base particles, the first internal lubricant is a composite of at least two types of lubricant; and second constituent particles including second metal base particles and a second internal lubricant that is adhered to a surface of the second metal base particles, the second internal lubricant is a composite of at least two types of lubricant, the composite of the second internal lubricant is different than the composite of the first internal lubricant; wherein the first constituent particles are different than the second constituent particles, the first constituent particles and the second constituent particles are mixed, and a first lubricant concentration is a mass proportion of the first internal lubricant adhered to the surface of the first metal base particles with respect to a total of the first constituent particles, a second lubricant concentration is a mass proportion of the second internal lubricant that is adhered to the surface of the second metal base particles with respect to the total of the second constituent particles, and the first lubricant concentration is greater than the second lubricant concentration, wherein a total amount of internal lubricant is 0.35 mass % or less with respect to 100% as the whole powder.

2. The powder for molding according to claim 1, wherein the first metal base particles have a first average particle diameter and the second metal base particles have a second average particle diameter, the first average particle diameter is greater than the second average particle diameter.

3. The powder for molding according to claim 1, wherein a lubricant concentration ratio (Lr=L2/L1) of the second lubricant concentration (L2) with respect to the first lubricant concentration (L1) ranges from 0.01 to 0.5.

4. The powder for molding according to claim 1, wherein the first lubricant concentration ranges from 0.4 to 5 mass %, and the second lubricant concentration is 0.2 mass % or less.

5. The powder for molding according to claim 1, wherein the first metal base particles are different than the second metal base particles.

6. The powder for molding according to claim 1, wherein the content of the first constituent particles is 3 to 30 mass % with respect to 100% as the whole powder.

7. The powder for molding according to claim 1, wherein the first metal base particles and the second metal base particles include iron base particles; and the composite of the first internal lubricant includes one or more from among fatty acid amides, higher alcohols, ester waxes, amide waxes and metal soaps.

8. A method for producing a metal member, comprising:

warm-molding a molded compact by pressing the powder for molding according to claim 1 inside a heated die.

9. The method for producing a metal member according to claim 8, further comprising:

sintering a sintered compact by heating the molded compact.

10. A lubricant-concentrated powder, comprising:

metal base particles, wherein a concentrated internal lubricant is adhered to a surface of the metal base particles;

a lubricant concentration, which is a mass proportion of the internal lubricant with respect to the metal base particles, ranges from 1 to 5 mass %; and the lubricant-concentrated powder constitutes a supply source of the first constituent particles according to claim 1.

11. The lubricant-concentrated powder according to claim 10, wherein the lubricant-concentrated powder is obtained by mixing of a metal powder of the metal base particles and the internal lubricant fully melted.

* * * * *